US012241252B2

(12) United States Patent
Kichise et al.

(10) Patent No.: US 12,241,252 B2
(45) Date of Patent: Mar. 4, 2025

(54) HANDRAIL

(71) Applicant: KAWASAKI RAILCAR MANUFACTURING CO., LTD., Kobe (JP)

(72) Inventors: Mitsutoshi Kichise, Kobe (JP); Takahiro Kawashima, Kobe (JP)

(73) Assignee: KAWASAKI RAILCAR MANUFACTURING CO., LTD., Kobe (JP)

( * ) Notice: Subject to any disclaimer, the term of this patent is extended or adjusted under 35 U.S.C. 154(b) by 428 days.

(21) Appl. No.: 17/687,849

(22) Filed: Mar. 7, 2022

(65) Prior Publication Data

US 2022/0186503 A1 Jun. 16, 2022

Related U.S. Application Data

(63) Continuation of application No. PCT/JP2020/028301, filed on Jul. 21, 2020.

(30) Foreign Application Priority Data

Sep. 5, 2019 (JP) ..... 2019-162186

(51) Int. Cl.
*E04F 11/18* (2006.01)

(52) U.S. Cl.
CPC ..... *E04F 11/1836* (2013.01); *E04F 11/1817* (2013.01); *E04F 2011/1821* (2013.01)

(58) Field of Classification Search
CPC ..... E04F 11/1817; E04F 11/1836; E04F 2011/1819; E04F 2011/1821; E04H 17/1447; E04H 17/1452; F16B 7/0413; F16B 7/042; F16B 7/182; F16B 21/10; F16B 21/12; F16B 21/14; F16B 21/18; F16B 21/183; F16B 21/186;
(Continued)

(56) References Cited

U.S. PATENT DOCUMENTS 3,079,185 A * 2/1963 Foster ..... F16B 7/0413 403/366
3,233,871 A * 2/1966 Schroer ..... F16B 7/0446 403/256
(Continued)

FOREIGN PATENT DOCUMENTS

EP 2078870 A2 * 7/2009 ..... F16B 7/182
FR 2703381 A1 * 10/1994 ..... E04F 11/1817
(Continued)

*Primary Examiner* — Josh Skroupa
(74) *Attorney, Agent, or Firm* — Oliff PLC

(57) ABSTRACT

A handrail includes a first partial handrail including an outer tube having at least one insertion hole on an outer peripheral surface of the outer tube, a second partial handrail including an inner tube having at least one opening hole on an outer peripheral surface of the inner tube, the inner tube being inserted into the outer tube, a cylindrical screw seat disposed inside the inner tube of the second partial handrail so as to be turnable in a circumferential direction and having at least one screw hole on an outer peripheral surface of the cylindrical screw seat, and at least one connecting bolt that penetrates the insertion hole and the opening hole and is fastened to the screw hole to couple the first partial handrail and the second partial handrail.

4 Claims, 4 Drawing Sheets

(58) Field of Classification Search
CPC ..... F16B 2200/69; F16B 2200/71; F16B 2200/73; Y10T 403/4617; Y10T 403/58; Y10T 403/581; Y10T 403/587; Y10T 403/589; Y10T 403/7041
USPC ..... 403/236, 315, 316, 319, 320, 362; 285/91; 256/65.02, 65.15
See application file for complete search history.

(56) References Cited

U.S. PATENT DOCUMENTS 3,279,835 A * 10/1966 Krohm ..... F16B 21/186 403/361
3,471,182 A * 10/1969 Schroer ..... E04F 11/1817 256/65.09
4,344,719 A * 8/1982 Thom ..... F16B 7/0413 403/374.3
4,706,367 A 11/1987 Garringer
4,846,600 A * 7/1989 Strand ..... F16B 7/18 403/264
5,765,812 A * 6/1998 Guenther ..... E04F 11/1836 403/368
6,409,221 B1 6/2002 Robinson et al.
7,198,425 B2 * 4/2007 Bergkvist ..... B62D 1/20 403/359.5
9,803,368 B1 * 10/2017 Stehl ..... E04F 11/1836
2014/0255091 A1 * 9/2014 Baek ..... F16B 12/40 403/345

FOREIGN PATENT DOCUMENTS

JP 5227628 B2 7/2013
JP 2016-084659 A 5/2016
JP 6046503 B2 12/2016

* cited by examiner

HANDRAIL

CROSS-REFERENCE TO RELATED APPLICATION

The present application is a bypass continuation of PCT Filing PCT/JP2020/028301, filed Jul. 21, 2020, which claims priority to JP 2019-162186, filed Sep. 5, 2019, both of which are incorporated by reference in their entirety.

BACKGROUND OF THE INVENTION

1. Field of the Invention

The present disclosure relates to a handrail.

2. Description of the Related Art

When a handrail is relatively long or includes a bent portion, the handrail is divided into partial handrails and is formed by coupling the partial handrails. Typically, the partial handrails are coupled to each other by inserting one of the partial handrails into the other partial handrail and fixing the partial handrails in this state (see Japanese Laid-Open Patent Application Publication No. 2016-84659, for example). According to this method, both of these partial handrails can be coupled to each other without the generation of a large level difference at a boundary of the partial handrails.

Moreover, the partial handrails are fixed to each other with a bolt. Specifically, an insertion hole is formed at an outer partial handrail, and a screw hole is formed at an inner partial handrail. Then, by inserting the bolt into the insertion hole and fastening the bolt to the screw hole, the partial handrails can be fixed to each other.

SUMMARY OF THE INVENTION

A handrail according to one aspect of the present disclosure includes: a first partial handrail including an outer tube having at least one insertion hole on an outer peripheral surface of the outer tube; a second partial handrail including an inner tube having at least one opening hole on an outer peripheral surface of the inner tube, the inner tube being inserted into the outer tube; a cylindrical screw seat disposed inside the inner tube of the second partial handrail so as to be turnable in a circumferential direction and having at least one screw hole on an outer peripheral surface of the cylindrical screw seat; and at least one connecting bolt that penetrates the insertion hole and the opening hole and is fastened to the screw hole to couple the first partial handrail and the second partial handrail.

DESCRIPTION OF THE PREFERRED EMBODIMENTS

Embodiment 1

Figure 1:
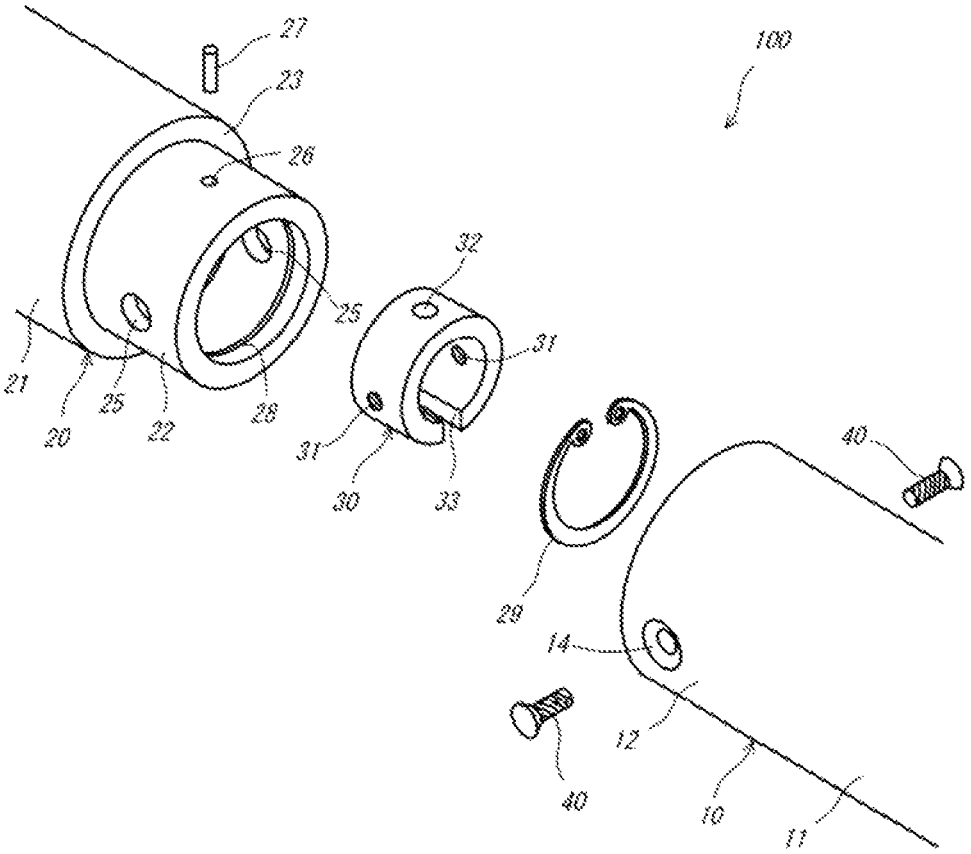
FIG. 1 is an exploded view of a handrail according to Embodiment 1.
Figure 2:
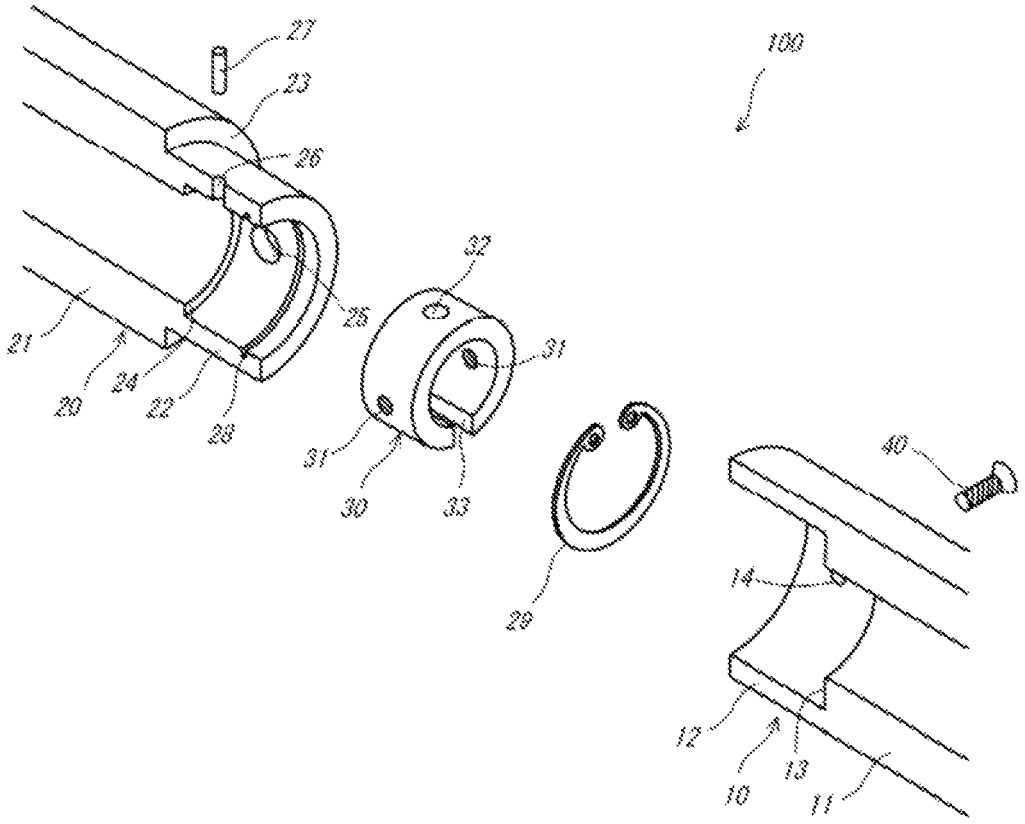
FIG. 2 is an exploded sectional view of the handrail shown in FIG. 1.

First, a handrail 100 according to Embodiment 1 will be described. FIG. 1 is an exploded view of the handrail 100 according to Embodiment 1. FIG. 2 is an exploded sectional view of the handrail 100 shown in FIG. 1. As shown in FIGS. 1 and 2, the handrail 100 includes a first partial handrail 10, a second partial handrail 20, a screw seat 30, and connecting bolts 40. Hereinafter, these components will be described in order.

First Partial Handrail

The first partial handrail 10 is a member that is coupled to the second partial handrail 20 and is directly touched by a hand of a user. The first partial handrail 10 of the present embodiment includes a main body 11 and an outer tube 12.

The main body 11 has a pipe shape and occupies most of the first partial handrail 10. An outer diameter of the main body 11 is equal to an outer diameter of the below-described outer tube 12. An inner diameter of the main body 11 is smaller than an inner diameter of the outer tube 12. Therefore, a level difference 13 is formed at an inside of the first partial handrail 10 and at an axial position where an inner diameter of the first partial handrail 10 changes.

The outer tube 12 is located at an axial end portion of the first partial handrail 10. The outer tube 12 has a tubular shape, and a below-described inner tube 22 of the second partial handrail 20 is inserted into the outer tube 12. Insertion holes 14 are formed on an outer peripheral surface of the outer tube 12. In the present embodiment, two insertion holes 14 are formed at the outer tube 12. The insertion holes 14 are formed so as to be separated from each other by 180° in a circumferential direction of the outer tube 12. The number of insertion holes 14 is not especially limited and may be one or may be three or more. Outer portions of the insertion holes 14 are so-called countersinks and can accommodate heads of the connecting bolts 40.

Second Partial Handrail

The second partial handrail 20 is a member that is coupled to the first partial handrail 10 and is directly touched by a hand of a user. The second partial handrail 20 of the present embodiment includes a main body 21 and the inner tube 22.

The main body 21 has a pipe shape and occupies most of the second partial handrail 20. An outer diameter of the main body 21 is equal to an outer diameter of the first partial handrail 10 and is larger than an outer diameter of the inner tube 22. Therefore, an outer level difference 23 is formed at an outside of the second partial handrail 20 and at an axial position where an outer diameter of the second partial handrail 20 changes. An inner diameter of the main body 21 is smaller than an inner diameter of the inner tube 22. Therefore, an inner level difference 24 is formed at an inside of the second partial handrail 20 and at an axial position where an inner diameter of the second partial handrail 20 changes.

The inner tube 22 is located at an axial end portion of the second partial handrail 20. The inner tube 22 is inserted into the outer tube 12 of the first partial handrail 10. The inner tube 22 has a tubular shape, and opening holes 25 are formed on an outer peripheral surface of the inner tube 22. In the present embodiment, as with the insertion holes 14, two opening hole 25 are formed at the inner tube 22. The opening holes 25 are formed so as to be separated from each other by 180° in a circumferential direction of the inner tube 22.

A diameter of the opening hole 25 of the present embodiment is larger than a diameter of the insertion hole 14 of the first partial handrail 10 and large than a diameter of a below-described screw hole 31 of the screw seat 30. For example, the diameter of the opening hole 25 is 1.5 times or more and two times or less larger than the diameter of the screw hole 31. In the present embodiment, the opening hole 25 has a circular section. However, the opening hole 25 may be an elongated hole extending in the circumferential direction of the inner tube 22. Moreover, the above-described two opening holes 25 may extend in the circumferential direction so as to be connected to each other.

One stopper hole 26 is formed on the outer peripheral surface of the inner tube 22. The stopper hole 26 of the present embodiment is located at an intermediate position between the two opening holes 25 in the circumferential direction of the inner tube 22. A stopper 27 is inserted into the stopper hole 26. The stopper 27 of the present embodiment is a so-called split pin. An outer end portion of the stopper 27 is located on the outer peripheral surface of the inner tube 22, and an inner end portion of the stopper 27 is located at a radially inner side of an inner peripheral surface of the inner tube 22. Moreover, a snap ring groove 28 is formed on the inner peripheral surface of the inner tube 22 entirely in the circumferential direction so as to be located outside the opening holes 25 in an axial direction.

Screw Seat

The screw seat 30 is a member located inside the inner tube 22 of the second partial handrail 20. The screw seat 30 has a cylindrical shape and can turn inside the inner tube 22 in the circumferential direction. The screw seat 30 includes the screw holes 31, the number of which is equal to the number of insertion holes 14. In the present embodiment, as with the insertion holes 14, two screw holes 31 are formed at the screw seat 30. These screw holes 31 are formed so as to be separated from each other by 180° in a circumferential direction of the screw seat 30.

One lock hole 32 is formed on an outer peripheral surface of the screw seat 30. The lock hole 32 of the present embodiment is located at an intermediate position between the two screw holes 31 in the circumferential direction of the screw seat 30. As described above, the stopper 27 is inserted into the stopper hole 26 of the second partial handrail 20. The stopper 27 penetrates the stopper hole 26, and the inner end portion of the stopper 27 is located inside the lock hole 32. With this, when the screw seat 30 turns by a certain angle or more, the stopper 27 is locked by the lock hole 32, and this restricts further turning of the screw seat 30. To be specific, the turning of the screw seat 30 is restricted within a predetermined range.

A slit 33 extending in the axial direction is formed at the screw seat 30. The slit 33 is located at an intermediate position between the two screw holes 31 in the circumferential direction of the screw seat 30 and at a position opposed to the lock hole 32. The slit 33 of the present embodiment extends from one of axial ends of the screw seat 30 to the other axial end. However, the slit 33 may be formed only at a partial axial portion of the screw seat 30. Moreover, instead of the slit 33, a groove may be formed at the screw seat 30.

Connecting Bolt

The connecting bolts 40 are bolts used to couple the first partial handrail 10 and the second partial handrail 20. The handrail 100 includes the connecting bolts 40, the number of which is equal to the number of insertion holes 14. The connecting bolt 40 is inserted into the insertion hole 14 from an outside of the first partial handrail 10, penetrates the opening hole 25 of the second partial handrail 20, and is fastened to the screw hole 31 of the screw seat 30. The connecting bolt 40 is a so-called flat countersunk head screw, and a head of the connecting bolt 40 is accommodated in an outer portion of the insertion hole 14.

Assembling Procedure

The components of the handrail 100 according to the present embodiment are described as above. The handrail 100 is assembled as below.

First, the screw seat 30 is inserted into the inner tube 22 from an opposite side of the main body 21 of the second partial handrail 20. Next, a snap ring 29 is inserted into the snap ring groove 28 of the inner tube 22. With this, the movement of the screw seat 30 inward in the axial direction of the inner tube 22 is restricted by the inner level difference 24, and the movement of the screw seat 30 outward in the axial direction of the inner tube 22 is restricted by the snap ring 29. To be specific, each of the inner level difference 24 and the snap ring 29 serves as a lock that restricts the movement of the screw seat 30 in the axial direction.

Next, the circumferential position of the lock hole 32 of the screw seat 30 and the circumferential position of the stopper hole 26 of the inner tube 22 are made to coincide with each other, and in this state, the stopper 27 is inserted into the stopper hole 26. At this time, the inner end portion of the stopper 27 is positioned inside the lock hole 32 of the screw seat 30.

Next, the inner tube 22 of the second partial handrail 20 is inserted into the outer tube 12 of the first partial handrail 10. At this time, the inner tube 22 is inserted into the outer tube 12 such that a tip surface of the inner tube 22 is brought into contact with the level difference 13 of the first partial handrail 10, and a tip surface of the outer tube 12 is brought into contact with the outer level difference 23 of the second partial handrail 20. With this, the axial positions of the insertion holes 14, the opening holes 25, and the screw holes 31 coincide with each other.

Next, the connecting bolt 40 is inserted into the insertion hole 14 from an outside of the first partial handrail 10, penetrates the opening hole 25 of the second partial handrail 20, and is fastened to the screw hole 31 of the screw seat 30. With this, the first partial handrail 10 and the second partial handrail 20 are coupled to each other. The screw seat 30 turns inside the inner tube 22. Therefore, even if one or both of around-axis angles of the first partial handrail 10 and of the second partial handrail 20 deviate from planned around-axis angles, the circumferential position of the insertion hole 14 and the circumferential position of the screw hole 31 can be made to coincide with each other.

Embodiment 2

Figure 3:
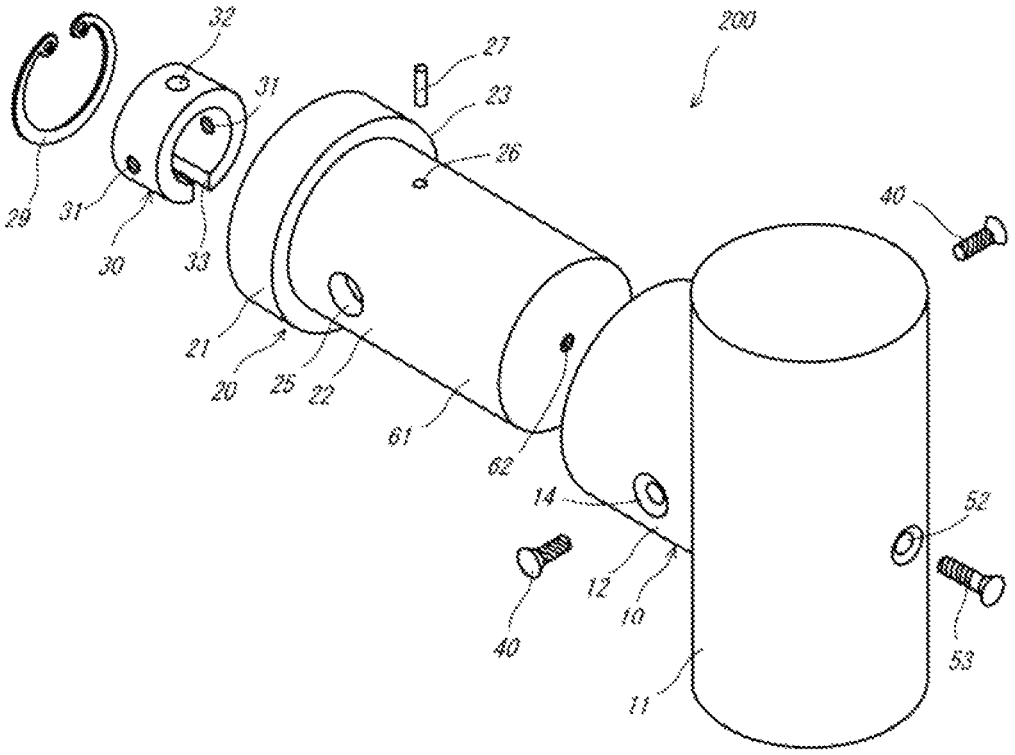
FIG. 3 is an exploded view of the handrail according to Embodiment 2.
Figure 4:
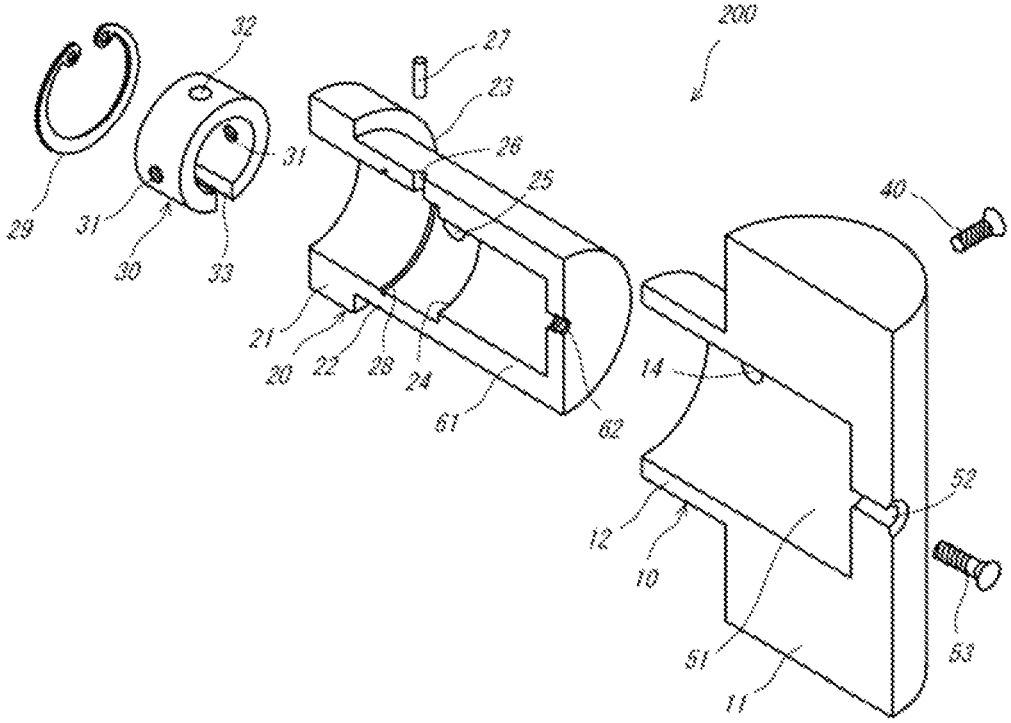
FIG. 4 is an exploded sectional view of the handrail shown in FIG. 3.

Next, a handrail 200 according to Embodiment 2 will be described. FIG. 3 is an exploded view of the handrail 200 according to Embodiment 2. FIG. 4 is an exploded sectional view of the handrail 200 shown in FIG. 3. Embodiments 1 and 2 are the same in configuration as each other regarding the screw seat 30 and the connecting bolts 40. However, Embodiments 1 and 2 are different in configuration from each other regarding the first partial handrail 10 and the second partial handrail 20.

Hereinafter, the first partial handrail 10 and the second partial handrail 20 according to Embodiment 2 will be mainly described. The reference signs that are the same as the reference signs used for the components of Embodiment 1 are used for the corresponding components shown in FIGS. 3 and 4, and the repetition of the same explanation is avoided.

As with the first partial handrail 10 of Embodiment 1, the first partial handrail 10 of Embodiment 2 includes the main body 11 and the outer tube 12. However, the main body 11 has a columnar shape instead of a pipe shape and extends in a direction perpendicular to a central axis of the outer tube 12. FIGS. 3 and 4 show a part of the main body 11 which part is located in the vicinity of the outer tube 12, and the other part of the main body 11 is not shown.

An inner peripheral surface that is continuous with an inner peripheral surface of the outer tube 12 extends inside the main body 11 and forms a hollow 51. Moreover, a communication hole 52 that communicates with the hollow 51 is formed on an outer peripheral surface of the main body 11. A fixing bolt 53 is inserted into the communication hole 52 and is fastened to a screw hole 62 of a below-described extension 61. An outer portion of the communication hole 52 is a so-called countersink, and the fixing bolt 53 is a so-called flat countersunk head screw.

As with the second partial handrail 20 of Embodiment 1, the second partial handrail 20 of Embodiment 2 includes the main body 21 and the inner tube 22. The inner diameter of the main body 21 and the inner diameter of the inner tube 22 are equal to each other. The snap ring groove 28 is located in the vicinity of a boundary between the main body 21 and the inner tube 22. FIGS. 3 and 4 show a part of the main body 21 which part is located in the vicinity of the inner tube 22, and the other part of the main body 21 is not shown.

The second partial handrail 20 of Embodiment 2 includes the extension 61. The extension 61 has a tubular shape and extends outward in the axial direction from the inner tube 22. A tip of the extension 61 is closed, and the screw hole 62 is formed at a middle of a circular tip surface of the extension 61. Moreover, an inner diameter of the extension 61 is smaller than the inner diameter of the inner tube 22, and the inner level difference 24 is formed at a position where the inner diameter of the second partial handrail 20 changes.

The components of the handrail 200 according to Embodiment 2 are described as above. The handrail 200 is assembled as below. First, the screw seat 30 is inserted into the inner tube 22 of the second partial handrail 20. At this time, the screw seat 30 is inserted from the main body 21 side. Then, the snap ring 29 is inserted into the snap ring groove 28 of the inner tube 22. Next, the circumferential position of the lock hole 32 of the screw seat 30 and the circumferential position of the stopper hole 26 of the inner tube 22 are made to coincide with each other, and in this state, the stopper 27 is inserted into the stopper hole 26. The inner end portion of the stopper 27 is positioned inside the lock hole 32 of the screw seat 30.

Next, the inner tube 22 and extension 61 of the second partial handrail 20 are inserted into the outer tube 12 and hollow 51 of the first partial handrail 10. Then, the connecting bolt 40 is inserted into the insertion hole 14 from an outside of the first partial handrail 10, penetrates the opening hole 25 of the second partial handrail 20, and is fastened to the screw hole 31 of the screw seat 30. Finally, the fixing bolt 53 is inserted into the communication hole 52 from an outside of the first partial handrail 10 and is fastened to the screw hole 62 of the extension 61. With this, the first partial handrail 10 and the second partial handrail 20 are coupled to each other.

Operational Advantages, Etc.

As above, each of the handrails 100 and 200 includes: the first partial handrail 10 including the outer tube 12 having at least one insertion hole 14 on the outer peripheral surface of the outer tube 12; the second partial handrail 20 including the inner tube 22 having at least one opening hole 25 on the outer peripheral surface of the inner tube 22, the inner tube 22 being inserted into the outer tube 12; the cylindrical screw seat 30 disposed inside the inner tube 22 of the second partial handrail 20 so as to be turnable in a circumferential direction and having at least one screw hole on the outer peripheral surface of the cylindrical screw seat 30; and at least one connecting bolt 40 that penetrates the insertion hole 14 and the opening hole 25 and is fastened to the screw hole 31 to couple the first partial handrail 10 and the second partial handrail 20.

According to this configuration, by turning the screw seat 30 inside the inner tube 22, the circumferential position of the screw hole 31 can be adjusted. Therefore, even if the partial handrails 10 and 20 to be coupled to each other are disposed such that one or both of around-axis angles of the partial handrails 10 and 20 deviate from planned around-axis angles, the position of the insertion hole 14 and the position of the screw hole 31 can be made to coincide with each other, and as a result, the partial handrails 10 and 20 can be coupled to each other.

Moreover, in each of the handrails 100 and 200, the at least one connecting bolt 40 includes the connecting bolts 40. The at least one insertion hole 14 of the first partial handrail includes the insertion holes 14. The at least one screw hole 31 of the screw seat 30 includes the screw holes 31, the number of which is equal to the number of insertion holes 14. The connecting bolts 40 are inserted into the corresponding insertion holes 14, penetrate the corresponding opening holes 25, and are fastened to the corresponding screw holes 31. The screw seat 30 includes the slit 33 or the groove extending in the axial direction.

According to this configuration, by the connecting bolts 40, the screw seat 30 is pulled outward in the radial direction at plural circumferential positions. At this time, since the screw seat 30 includes the slit 33 or the groove, the screw seat 30 deforms so as to spread outward in the radial direction. As a result, the outer peripheral surface of the screw seat 30 tightly contacts the inner peripheral surface of the inner tube 22. Thus, the screw seat 30 can be strongly fixed to the inner tube 22.

Moreover, as described above, the inner tube 22 of the second partial handrail 20 includes the stopper 27 that restricts the turning of the screw seat 30 within a predetermined range.

According to this configuration, it is possible to prevent a case where the screw seat 30 excessively turns, and therefore, the circumferential position of the screw hole 31 largely deviates from the circumferential position of the opening hole 25, and the position of the screw hole 31 becomes unrecognizable. In the above-described embodiment, the stopper 27 is located inside the lock hole 32 of the screw seat 30. However, the stopper 27 may be arranged so as to be located inside the slit 33.

Moreover, the second partial handrail 20 includes the locks 24 and 29 that restrict the movement of the screw seat 30 in the axial direction.

According to this configuration, the position adjustment of the screw seat 30 in the axial direction when assembling the handrails 100 and 200 can be omitted or simplified.

From the foregoing description, numerous modifications and other embodiments of the present disclosure are obvious to those skilled in the art. Accordingly, the foregoing description is to be construed as illustrative only, and is provided for the purpose of teaching those skilled in the art the best mode for carrying out the present disclosure. The structural and/or functional details may be substantially modified without departing from the scope of the present disclosure.

What is claimed is:

1. A handrail comprising:

a first partial handrail including an outer tube having at least one insertion hole on an outer peripheral surface of the outer tube;

a second partial handrail including an inner tube having at least one opening hole on an outer peripheral surface of the inner tube, the inner tube being inserted into the outer tube;

a cylindrical screw seat disposed inside the inner tube of the second partial handrail so as to be turnable in a circumferential direction and having at least one screw hole on an outer peripheral surface of the cylindrical screw seat; and at least one connecting bolt that penetrates the insertion hole and the opening hole and is fastened to the screw hole to couple the first partial handrail and the second partial handrail.

2. The handrail according to claim 1, wherein:

the at least one connecting bolt comprises connecting bolts;

the at least one insertion hole of the first partial handrail comprises insertion holes;

the at least one screw hole of the screw seat comprises screw holes, the number of which is equal to the number of insertion holes;

the connecting bolts are inserted into the corresponding insertion holes, penetrate the at least one opening hole, and are fastened to the corresponding screw holes; and the screw seat includes a slit or a groove extending in an axial direction.

3. The handrail according to claim 1, wherein the inner tube of the second partial handrail includes a stopper that restricts turning of the screw seat within a predetermined range.

4. The handrail according to claim 1, wherein the second partial handrail includes a lock that restricts movement of the screw seat in an axial direction.

* * * * *